US010266987B2

(12) United States Patent
Slaven, Jr. et al.

(10) Patent No.: US 10,266,987 B2
(45) Date of Patent: Apr. 23, 2019

(54) APPARATUS AND METHOD FOR PROCESSING BAMBOO OR VEGETABLE CANE

(71) Applicant: Resource Fiber LLC, Homewood, AL (US)

(72) Inventors: Leland Slaven, Jr., Land O Lakes, FL (US); David Knight, Bainbridge Island, WA (US)

(73) Assignee: Resource Fiber LLC, Homewood, AL (US)

( * ) Notice: Subject to any disclaimer, the term of this patent is extended or adjusted under 35 U.S.C. 154(b) by 677 days.

(21) Appl. No.: 14/673,659

(22) Filed: Mar. 30, 2015

(65) Prior Publication Data

US 2015/0275428 A1 Oct. 1, 2015

Related U.S. Application Data

(60) Provisional application No. 61/973,358, filed on Apr. 1, 2014.

(51) Int. Cl.
*D21B 1/06* (2006.01)

(52) U.S. Cl.
CPC ..... *D21B 1/061* (2013.01)

(58) Field of Classification Search
CPC ..... B27J 1/00; B27J 1/003; B27J 1/006; B27J 7/00; D21B 1/06; D21B 1/061; D21F 7/00; D21F 7/006
USPC ..... 144/4, 4.6, 24.17, 156
See application file for complete search history.

(56) References Cited

U.S. PATENT DOCUMENTS 221,720 A * 11/1879 Colburn ..... B27J 1/00 144/156
2,723,693 A * 11/1955 Hayashiguchi ..... B27J 1/00 144/333
2,858,990 A * 11/1958 Honeyman ..... B02C 7/06 241/261.1
3,464,877 A * 9/1969 Creighton ..... B27J 1/00 156/259
5,679,191 A * 10/1997 Robinson ..... B27M 3/002 144/351
5,972,467 A * 10/1999 Washo ..... B27J 1/00 144/333
6,098,680 A * 8/2000 Nien ..... B27J 1/00 144/3.1

(Continued)

*Primary Examiner* — Jessica Cahill
*Assistant Examiner* — Smith Oberto Bapthelus
(74) *Attorney, Agent, or Firm* — Perkins Coie LLP

(57) ABSTRACT

One embodiment provides a cane processing assembly for use with a substantially cylindrical bamboo culm having a longitudinal axis and a plurality of nodes. The assembly comprising a feeder, a perforating station adjacent to the feeder to receive the culm, the perforating station having an annular cutter assembly with cutting blades positioned around an open central area that receives the culm. The cutting blades are radially movable between retracted and extended positions, wherein the cutting blades are positioned to cut into a node around the circumference of the culm. A splitter station receives the culm after the perforating station. The splitter station has a splitting blade configured to cut the culm along its length. A planar station adjacent to the splitter station has a plurality of rollers positioned to engage and flatten the cut culm into a planar configuration.

11 Claims, 5 Drawing Sheets

(56) References Cited

U.S. PATENT DOCUMENTS

| | | | | |
|---|---|---|---|---|
| 7,166,181 | B2 * | 1/2007 | Cable | B27D 1/10 144/344 |
| 7,785,681 | B2 * | 8/2010 | Liao | B25G 1/10 144/333 |
| 8,245,742 | B2 * | 8/2012 | Filion | B27F 1/16 144/346 |
| 2008/0023868 | A1 * | 1/2008 | Slaven | B27N 1/00 264/109 |
| 2010/0178451 | A1 * | 7/2010 | Li | B27J 1/00 428/106 |
| 2014/0000761 | A1 * | 1/2014 | Peng | D01B 9/00 144/3.1 |

* cited by examiner

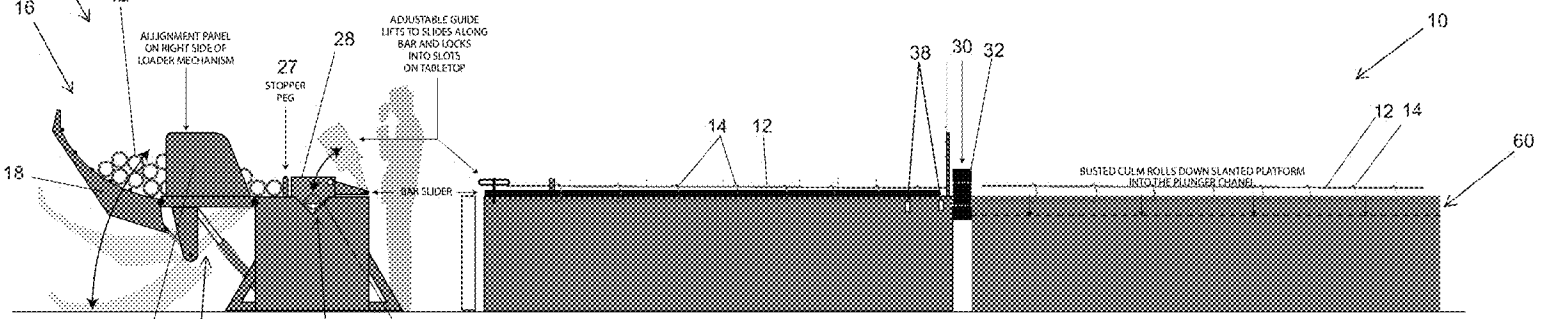
Fig. 2
Fig 3
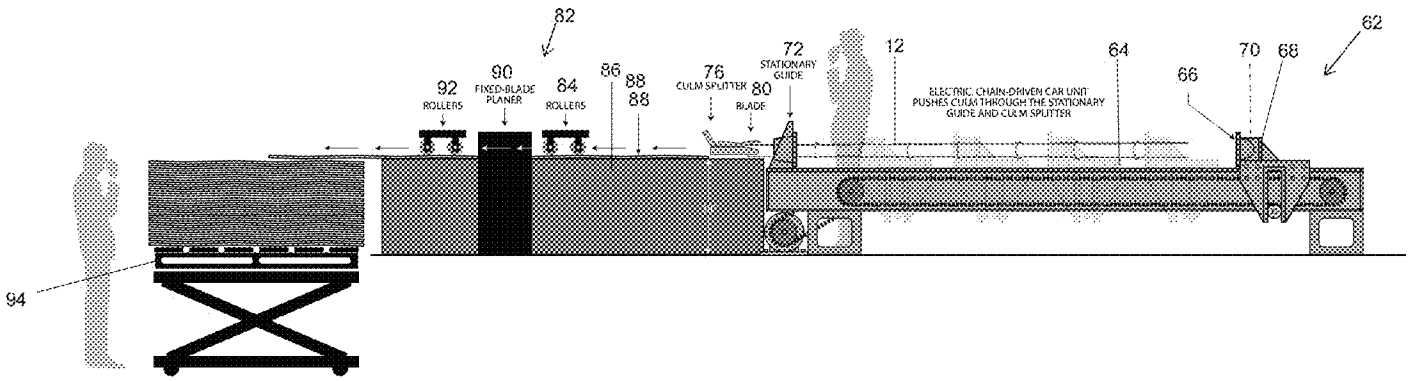
Fig. 6

APPARATUS AND METHOD FOR PROCESSING BAMBOO OR VEGETABLE CANE

CROSS-REFERENCE TO RELATED APPLICATION

This application hereby claims priority to and the benefit of U.S. Provisional Patent Application No. 61/973,358, titled Apparatus and Method for Processing Bamboo or Vegetable Cane, filed Apr. 1, 2014, and which is incorporated herein in its entirety by reference thereto.

TECHNICAL FIELD

This disclosure relates to stationary or mobile systems, components and associated methods of processing bamboo and/or vegetable cane, including creating opened, flattened sheets of bamboo and/or other cane material.

BACKGROUND

Bamboo and other vegetable cane are very fibrous and popular for use as building and textile materials. The cylindrical bamboo stalks or culms have a plurality of nodes spaced apart along their length, and these nodes create substantial difficulties in processing the culms without damaging or shredding the long fibers between the nodes. For example, bamboo culms have been harvested and processed by hand using an ax or the like to break the nodes and slice the culms longitudinally to allow the culms to be flattened. This conventional hand processing of bamboo culms is inefficient and very labor-intensive. There is a need for improvements in processing bamboo to provide substantially flat sheets of the fibrous material while allowing the material to remain joined together in a planar configuration after splitting the culms longitudinally.

SUMMARY

The present disclosure describes embodiments of apparatus, systems, and methods for processing bamboo and/or other vegetable cane that overcomes the drawbacks in the prior art and provides other benefits. In at least one embodiment, a system is provided for processing bamboo culms to provide substantially flat sheets while allowing the fibrous materials to remain joined together after the culm is split longitudinally along its length. The system includes apparatus that pierces, cuts, splits and/or separates bamboo or other vegetable cane culms in multiple areas along its length, such as at the nodes, to allow the culm to remain joined together after fully separating the culm open along its length on one side so the originally cylindrical culm is flattened in a substantially planar configuration.

BRIEF DESCRIPTION OF DRAWINGS

FIG. 2 is a schematic side elevation view of a node-buster station of the system of FIG. 1.

FIG. 3 is a schematic end elevation view of the node-buster station of FIG. 2.

FIG. 6 is a schematic side elevation view of a culm-splitter station of the system of FIG. 1.

DETAILED DESCRIPTION

Figure 1:
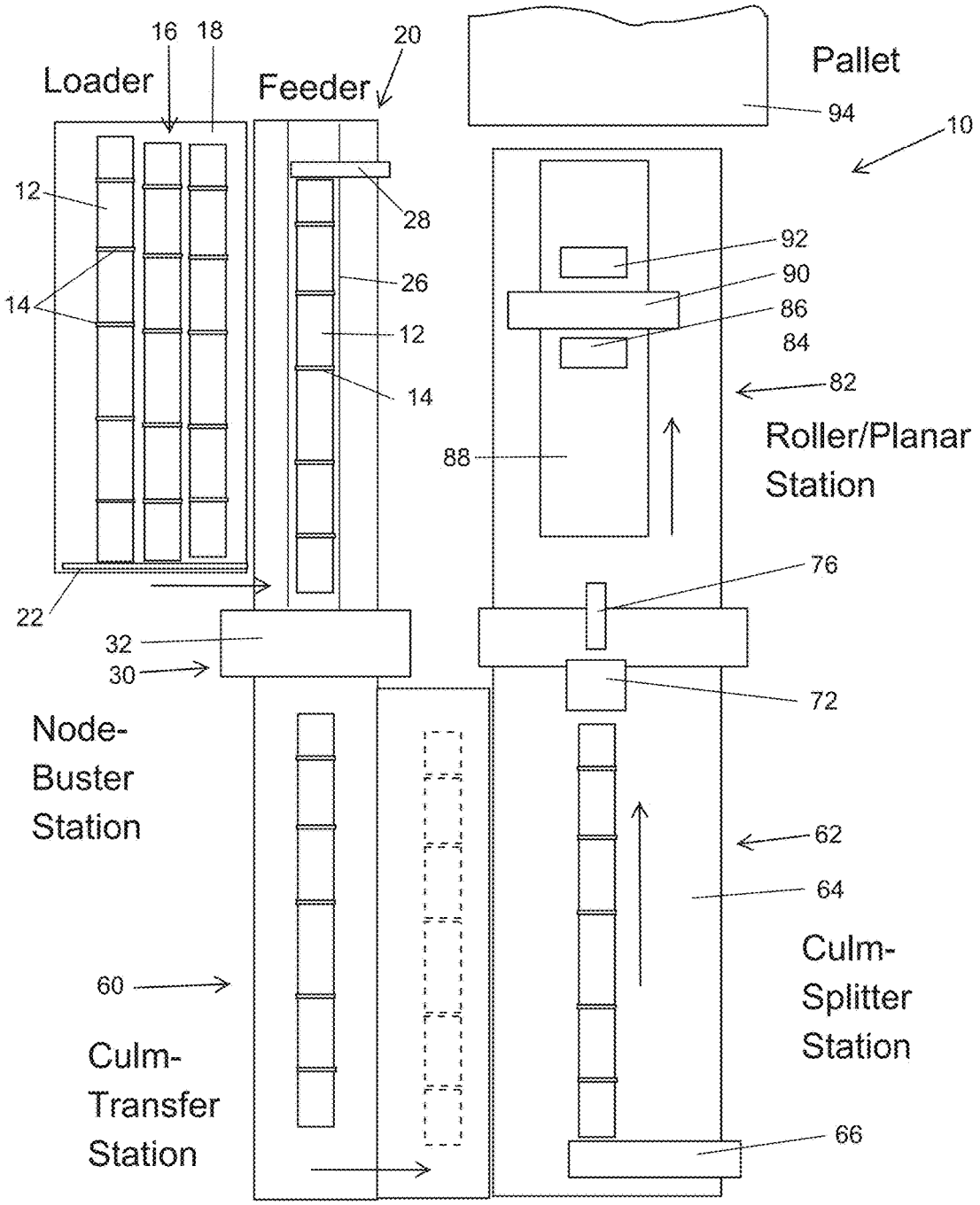
FIG. 1 is a schematic view of a system for processing bamboo culms and/or other vegetable cane culms in accordance with an embodiment of the present disclosure.

Several embodiments of the technology are described in more detail in reference to FIGS. 1-8. Embodiments in accordance with the present disclosure are set forth hereinafter to provide a thorough understanding and enabling description of a number of particular embodiments. Numerous specific details of various embodiments are described below. In some instances, well-known structures or operations are not shown, or are not described in detail to avoid obscuring aspects of this technology. A person skilled in the art will understand, however, that the technology may have additional embodiments, or that the technology may be practiced without one or more of the specific details of the embodiments as shown and described.

The following discussion provides an illustrative example of the technology and components in connection with a system for processing bamboo to perforate, split and flatten bamboo culms into substantially planar in-tact sheets of bamboo. The following discussion provides an illustrative example of the technology and components in connection with the system and associated methods. One or more specific and alternative embodiments of the present invention will now be described with reference to the attached drawings. It shall be apparent to one skilled in the art, however, that this invention may be practiced without such specific details. Some of the details may not be described at length so as not to obscure the invention. For ease of reference, common reference numerals or series of numerals will be used throughout the figures when referring to the same or similar features common to the figures.

FIG. 1 is a schematic view of a system 10 for processing bamboo culms 12 in accordance with an embodiment of the present disclosure. FIGS. 2 and 3 are schematic side and end elevation views of a node-buster station of the system 10. While the illustrated embodiment is discussed in connection with processing bamboo, it is to be understood that the system 10 and/or aspects of the system 10 can be used for processing other fibrous vegetable cane. Further, the system 10 and its components can be arranged in a stationary configuration, such as in a factory, or the system and its components can be provided on a mobile configuration that allows the system 10 to be moved and operated at selected locations.

The bamboo culms 12 are received into the system 10 as raw, harvested, non-dried culms cut to a selected length. In one embodiment, the system 10 is configurable to handle culms cut to lengths in the range of approximately two feet to twelve feet, although other lengths can be used. Typically, the bamboo culms 12 are processed in the system 10 in batches, and the selected culms 12 have a generally uniform length. When the bamboo culms 12 are loaded into the system 10, each culm 12 has a substantially cylindrical, hollow configuration with a plurality of nodes 14 spaced apart from each other along the length of the culm 12.

The system 10 has a loader 16 with a hopper portion 18 that supports a plurality of raw, cylindrical bamboo culms 12 in a substantially parallel orientation with the leading ends of the culms 12 generally aligned. The loader 16 can include an alignment panel 22 (FIG. 3) that assists in longitudinally aligning the bamboo culms 12 so the leading ends are substantially aligned. The loader 16 is adjacent to a feeder assembly 20, and the loader is configured to transfer the bamboo culms 12 one at a time to the feeder assembly. In the illustrated embodiment, the bamboo culms 12 move from the loader 16 to the feeder assembly 20 by rolling in a direction perpendicular to the culm's longitudinal axis. The feeder assembly 20 has an alignment portion 24 that receives each bamboo culm 12 and aligns it in a known location substantially aligned with the longitudinal axis of the feeder assembly 20. In the illustrated embodiment, the alignment portion 24 is a groove, such as a V-shaped alignment groove 26 into which the bamboo culm 12 rests as it is received from the loader 16.

The feeder assembly 20 has a stopper 27 adjacent to the alignment groove 26 and positioned to block the other bamboo culms 12 in the hopper portion 18 from prematurely rolling into the alignment groove 26. The stopper 27 can be a retractable peg or plate that moves between blocking and retracted positions to allow one bamboo culm 12 at a time to roll into the alignment groove 26 when in the retracted position and then returns to the blocking position to prevent the other bamboo culms 12 from rolling laterally. Once the bamboo culm 12 in the alignment groove 26 has been moved and cleared from the alignment portion 24, the stopper 27 is activated to allow the next bamboo culm 12 to move into the alignment groove 26.

In one embodiment, the bamboo culm 12 is advanced along the alignment portion by a user manually grasping and pushing the culm along the alignment groove. In another embodiment, the feeder has an adjustable pusher 28 positioned adjacent to the alignment groove 26 at approximately the trailing end of a bamboo culm 12 settled in the groove. The pusher 28 can be a passive pusher that a user engages and manually pushes so as to slide the culm axially in the alignment groove 26. This passive pusher allows the user to control the rate and distance by which each culm 12 is advanced, such as to accommodate for different distances between nodes 14 on the culms 12. The passive pusher also allows a user to rotate the culm 12 about its central axis, either manually or automatically, as the culm sequentially advances along the feeder assembly.

In yet another embodiment, the pusher 28 can be an automated pusher connected to an axial drive member that drives the pusher 28 parallel to the groove 26 so as to push the bamboo culm 12 axially along the groove 26 through a node-buster station 30. After the pusher 28 moves the bamboo culm 12 through the node-buster station 30, the pusher 28 returns to its rearward position and is ready to engage and axially push the next bamboo culm 12 that has been loaded into the feeder's alignment groove 26.

Figure 4:
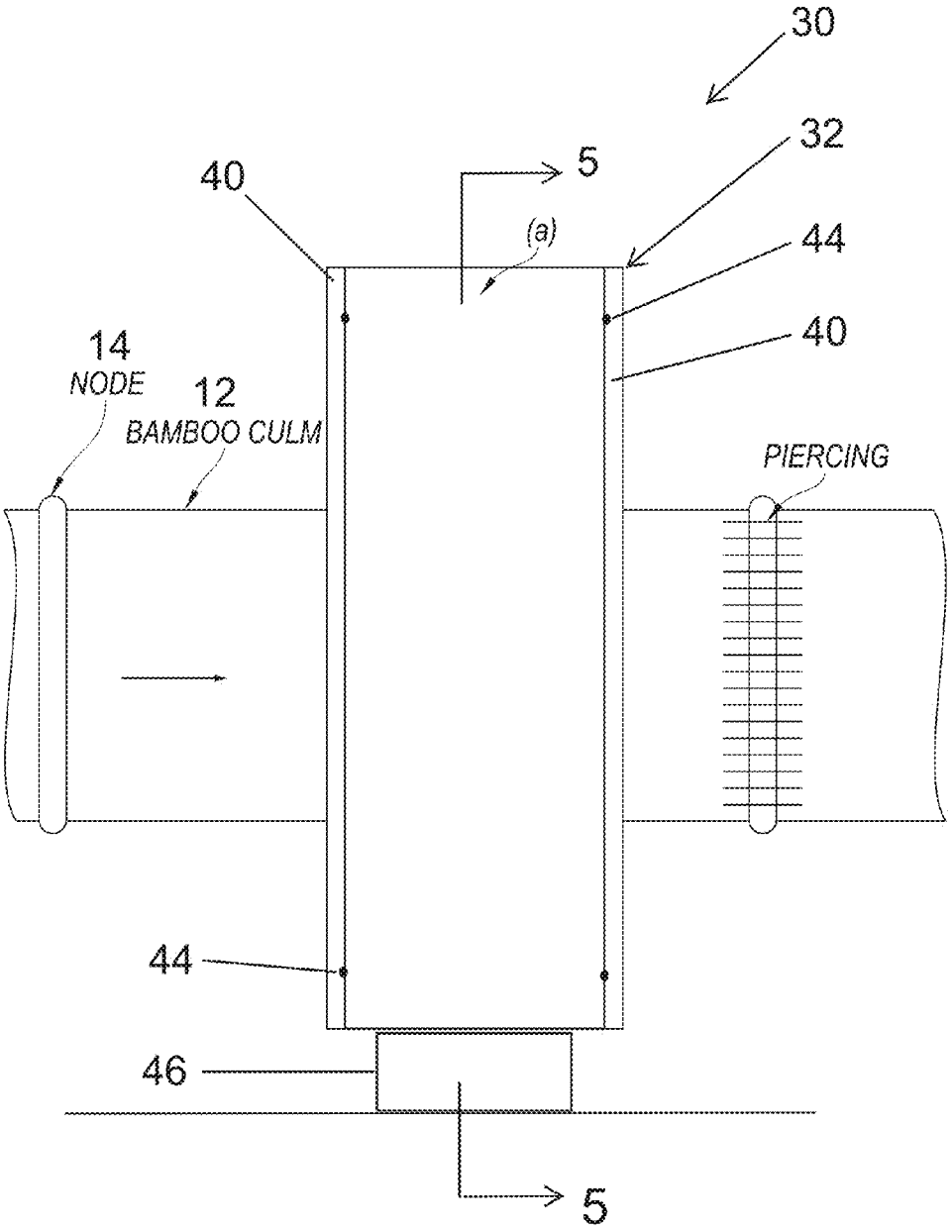
FIG. 4 is an enlarged schematic side elevation view of a cutter assembly of the node-buster station of FIG. 2.
Figure 5:
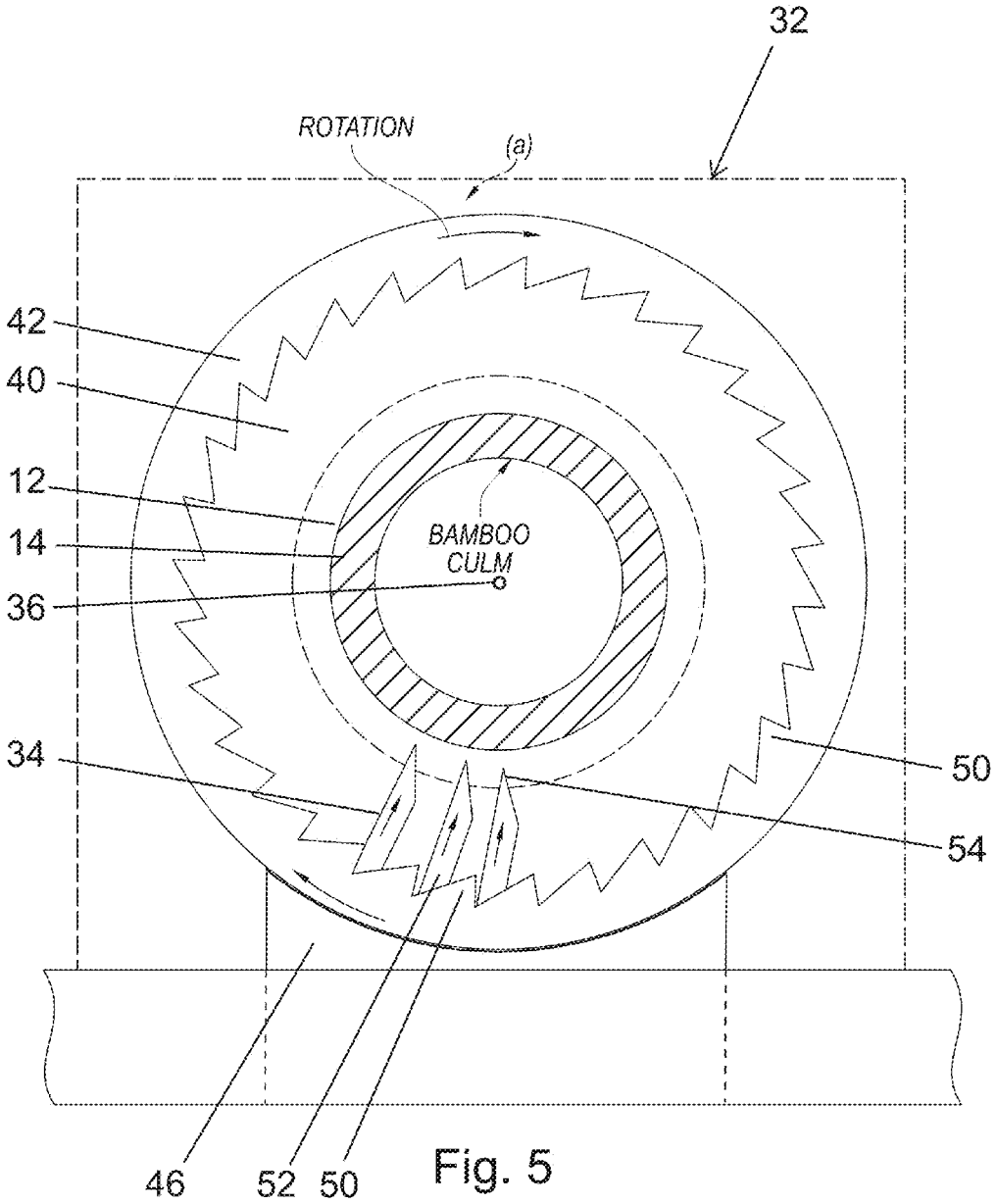
FIG. 5 is an enlarged cross-sectional view of the cutter assembly taken substantially along lines 5-5 of FIG. 4.

The node-buster station 30 has an annular cutter assembly 32 generally coaxially aligned with the bamboo culm 12 in the alignment groove 26. FIGS. 4 and 5 are enlarged schematic side elevation and cross-sectional views of the cutter assembly 32 of the node-buster station 30. As discussed in greater detail below, the annular cutter assembly 32 has an open central area that receives the bamboo culm 12 therein as the culm is pushed from the feeder assembly. The cutter assembly 32 has a plurality of cutting blades 34 (FIG. 5) radially disposed around the central axis 36 of the cutter assembly. The cutter assembly 32 is activated when a node 14 of the bamboo culm 12 is aligned with the cutting blades 34. The cutting blades 34 are driven radially inwardly and pierce and perforate the node 14, thereby cutting the fibers in the node so as to effectively break or bust the fibrous integrity of the node 14.

The feeder assembly 20 is configured to sequentially advance the bamboo culm 12 longitudinally into the cutter assembly 32 by a distance substantially corresponding to the space between the nodes 14, thereby sequentially positioning each node adjacent to the cutting blades 34 in the cutter assembly. In one automated embodiment, the feeder assembly 20 and/or the cutter assembly 32 can include one or more sensors 38, such as optical, mechanical, or other suitable sensors, that detects the nodes 14 and the distance between the nodes. The sensors 38 are coupled to a controller and the pusher 28, such that the pusher 28 will advance axially the proper distance to align each node 14 until it is adjacent to the cutting blades 34 and in position to be pierced by the blades.

After a node 14 has been cut or perforated and the cutting blades 34 retracted, the pusher 28 is moved or activated to advance the bamboo culm 12 through the cutter assembly 32 until the next node 14 is aligned with the cutting blades 34. Accordingly, the cutter assembly 32 cuts the fibers in the nodes 14 and essentially does not cut or otherwise destroy the integrity of the long fibers in the culm 12 between the nodes 14. As indicated above, the feeder assembly 20 is configured so the culm 12 can be rotated, manually or automatically, as the culm 12 advances to sequentially position the nodes 14 in the cutter assembly adjacent to the cutting blades 34. This rotation of the culm 12 result in the cuts in one node 14 to be axially misaligned with the cuts on the adjacent perforated nodes. This axial misalignment of the cuts help maintain the overall integrity of the culm 12 after it has been split and flattened, as discussed in greater detail below.

As seen in FIGS. 4 and 5, the cutter assembly 32 has a pair of spaced apart, stationary end plates 40 that carry an annular blade driver while being rotated 42 coupled to the cutting blades 34. In the illustrated embodiment, the end plates 40 have a plurality of bearings 44 that carries the blade driver 42 for rotation about the central axis 36. The blade driver 42 is connected to a driver mechanism 46, such as a drive motor, operable to rotate the blade driver 42 about its central axis relative to the stationary end plates 40. The driver mechanism 46 can be an automated or manual device to selectively rotate the blade driver 42. The end plates 40 have central apertures 48 substantially coaxially aligned with the central axis 36 and sized to allow the bamboo culms 12 to move axially through the cutter assembly 32.

As seen in FIG. 5, the blade driver 42 is an annular structure coupled to the driver mechanism 46 and has a plurality of internal angular teeth 50 that engage the cutting blades 34. Each angled tooth 50 is connected to a proximal portion 52 of a respective one of the plurality of cutting blades 34, such that cutting blades 34 are provided around the entire interior circumference of the blade driver 42. For purposes of illustration, FIG. 5 shows only three of the cutting blades 34 located around the interior of the cutter assembly 32. It is to be understood, however, that the cutting blades 34 extend around the circumference of the blade driver 42 so as to pierce and perforate the node 14 around the entire circumference of the culm 12.

In the illustrated embodiment, the blade driver 42 has multiple angular teeth 50 and multiple corresponding cutting blades 34. Each cutting blade 34 is radially aligned with a distal cutting edge 54 directed inwardly generally toward the central axis 36. Each cutting blade 34 is configured to slide radially and fully pierce the culm's node 14 and cut the node's fibers with the distal cutting edge 54 when the blade driver 42 is rotated relative to the blades 34 and the end plates 40. The blades 34 move radially inwardly at a uniform rate such that the blades 34 will engage the culm 12 around the node's circumference, thereby assisting with maintaining radial alignment of the culm within cutter assembly 32. The blades 34 are spring-loaded or otherwise biased radially outwardly so the blades 34 will automatically retract after piercing the node 14. Accordingly, the blade driver's angular teeth 50 and the cutting blades 34 operate in a ratchet type fashion to cut the nodes 14, thereby effectively perforating the bamboo culms 12 at the nodes 14 so as to separate the fibrous integrity of the nodes. Although the illustrated embodiment utilizes a configuration with multiple angular teeth 50 and cutting blades 34, other embodiments can have a different number of blades and/or corresponding angular teeth. In addition, the shape and size of the teeth 50 can be selected to control the radial distance along which the cutting blades 34 travel for each rotational position of the blade driver 42.

After the bamboo culm 12 is pushed or otherwise passed through the cutter assembly 32, each of the nodes 14 are fully perforated and the bamboo culm 12 is received by a culm-transfer station 60 (FIGS. 1 and 2) located behind the node-buster station 30. The culm-transfer station 60 is arranged at a slight incline in a direction perpendicular to the longitudinal axis of the bamboo culm 12, such that the bamboo culm 12 received from the node-buster station 30 will roll laterally onto an adjacent culm-splitter station 62.

The culm-splitter station 62 has a receiving platform 64 that receives the bamboo culms 12 from the transfer station 60 so the bamboo culm 12 is substantially parallel to the station's longitudinal axis. The culm-splitter station 62 has an advancing mechanism, such as a push carriage 66, positioned to engage the end of the bamboo culm 12 and advance the culm in a direction substantially parallel to its longitudinal axis. The push carriage 66 of the illustrated embodiment is a driven carriage, such as a chain or belt driven carriage, that moves between a retracted position and an advanced position. When the push carriage 66 is in the retracted position, the bamboo culm 12 is rolled onto the receiving platform 64. The push carriage 66 has an alignment portion 68 that engages the end of the bamboo culm 12 and aligns the culm on the splitter station. In the illustrated embodiment, the alignment portion 68 is a bowl-shaped centering device 70 that engages and centers the culm.

Figure 7:
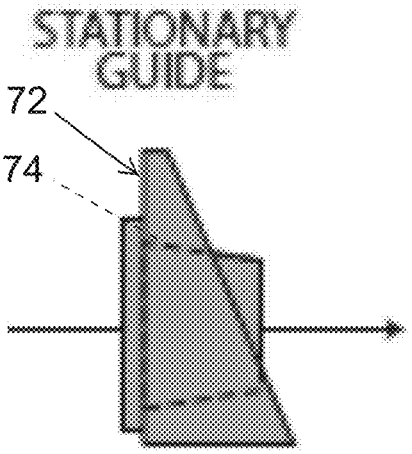
FIG. 7 is an enlarged side elevation view of a stationary guide shown removed from the culm-splitter station of FIG. 6.

The opposite end of the culm-splitter station 62 has a stationary guide 72 coaxially aligned with the cone-shaped centering device 70. FIG. 7 is an enlarged side elevation view of the stationary guide 72 shown removed from the culm-splitter station 62. The stationary guide 72 has a tapered opening 74 shaped and sized to receive the end of the bamboo culms 12 when the push carriage 66 (FIG. 6) moves from the retracted position to the advanced position so as to advance the culm longitudinally. In the illustrated embodiment, the tapered opening 74 has a substantially frustoconical shape, although other shapes or devices can be used to maintain alignment of the bamboo culm 12 passing there through.

Figure 8:
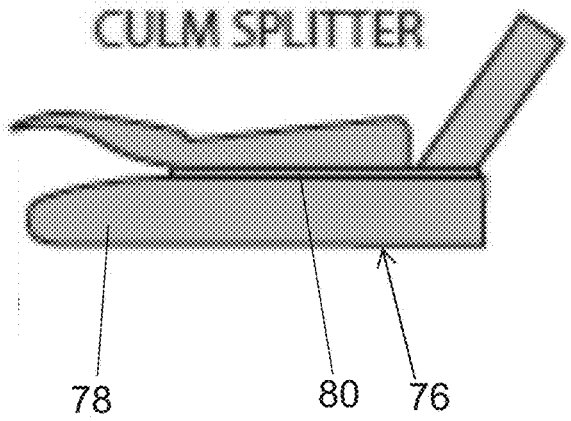
FIG. 8 is an enlarged side elevation view of a culm splitter shown removed from the culm-splitter station of FIG. 6.

The stationary guide 72 is coaxially aligned with a culm-splitter assembly 76 located substantially immediately adjacent to the end of the stationary guide 72. FIG. 8 is an enlarged side elevation view of the culm-splitter assembly 76 shown removed from the culm splitter station 62. The culm-splitter assembly 76 is configured to fully slice or separate one side of the bamboo culm 12 along the culm's entire length so as to allow the culm 12 to open from a cylindrical configuration to a flattened substantially planar configuration. In the illustrated embodiment, the culm-splitter assembly 76 has a mandrel 78 aligned with the opening of the stationary guide 72 and sized to slide into the central area of the culm 12. The mandrel 78 helps keep the bamboo culm 12 longitudinally aligned on the culm-splitter assembly 76 and to help avoid binding in the stationary guide 72. The culm-splitter assembly 76 also has a longitudinally oriented splitter blade 80 positioned adjacent to the mandrel 78 to engage and slice one side of the bamboo culm 12 as the push carriage 66 pushes the culm axially through the stationary guide 72 and onto a roller/planar station 82.

As the bamboo culm 12 is pushed over the splitter blade 80, the sliced or separated bamboo culm 12 substantially falls open to a generally flat, planer configuration. The bamboo culm 12 can open to the flat, planar configuration easily and quickly as it moves onto the roller/planar station 82 because fibers in the node 14 were cut or separated by the blades 34 (FIG. 5). In addition, bamboo culm 12 tends to fracture along the weakest longitudinal fibers extending between the notes 14 as the culm opens to the flat, planar configuration, thereby leaving the strongest bamboo fibers fully intact. The flattened culm 12 also maintains its integrity as a unitary sheet because the cuts or separations in the perforated nodes 14 are misaligned, thereby preventing the flattened culm from inadvertently breaking into separate pieces.

As seen in FIG. 6, the roller/planar station 82 has a plurality of driven rollers 84 spaced above a support platform 86 and positioned to engage the top surface 88 of the bamboo culm 12 in the flat, planar configuration. The top surface 88 of the culm 12 corresponds to the interior of the bamboo culm when in the cylindrical configuration. The rollers 84 pull the laid-open culm 12 away from the culm-splitter assembly 76 and flattened the culm on the support platform 86. The rollers 84 also drive the flattened culm 12 through a planer 90, such as a fixed or rotating blade planer, that trims at least the culm's top surface 88. In at least one embodiment, the planer 90 is configured to trim the top and bottom surfaces of the flattened culm 12.

Another plurality of rollers 92, such as driven rollers, adjacent to the planer 90 engage the flat, planed culm 12 as it exits the planer 90 and drives the flat, planed culm away from the planer and onto a pallet 94 adjacent to the end of the roller/planer station 82. Accordingly, the flat, planed culms are stacked on to the pallet, which can be moved and replaced with a new pallet when the first pallet is fully loaded. Accordingly, the bamboo culms 12 can be quickly and easily processed from raw, cylindrical culms received directly from harvesting to flat, planed culms in a very fast, efficient, low-cost manner while the bamboo is still in a green, undried state. In at least one embodiment, the system or portions of the system 10 can be provided on a mobile structure, such that the system 10 can be transported to a selected processing area. For example, the mobile system 10 can be moved to a processing area where the bamboo culms 12 are being harvested.

From the foregoing, it will be appreciated that specific embodiments of the technology have been described herein for purposes of illustration, but that various modifications may be made without deviating from the spirit and scope of the technology. Further, certain aspects of the technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The above Detailed Description of examples of the disclosure is not intended to be exhaustive or to limit the disclosure to the precise form disclosed above. While specific examples for the disclosure are described above for illustrative purposes, various equivalent modifications are possible within the scope of the disclosure, as those skilled in the relevant art will recognize. The teachings of the disclosure provided herein can be applied to other apparatus, systems and/or methods, not necessarily those described above. The elements and acts of the various examples described above can be combined to provide further implementations of the disclosure. Some alternative implementations of the disclosure may include not only additional elements to those implementations noted above, but also may include fewer elements. Thus, the disclosure is not limited except as by the appended claims.

We claim:

1. A cane processing assembly for use with a substantially cylindrical segment of bamboo culms or vegetable canes, wherein the segment has a longitudinal axis and a plurality of spaced apart fibrous nodes, the assembly comprising:

a feeder positioned to receive a segment from the plurality of segments, wherein the feeder has a first support platform and a feeding member movable relative to the first support platform, wherein the feeding member is configured to engage and move the segment relative to the first support platform in a direction substantially parallel to the segment's longitudinal axis;

a perforating station adjacent to the feeder and positioned to receive the segment moved by the feeding member wherein the segment is moved axially through the perforating station, the perforating station having an annular cutter assembly with blades positioned around an open central area that receives the segment, the blades being radially movable between retracted and extended positions, wherein the blades are positioned to radially perforate a node of the segment substantially around the circumference of the segment when the blades move from the retracted position to the extended position, the cutter assembly having a blade driver coupled to the blades and activatable to move the blades between the retracted and extended positions;

a splitter station positioned to receive the segment after the segment has moved through the perforating station, the splitter station comprising a second support platform and a transporter movable relative to the second support platform to move the segment axially in a direction substantially parallel to the longitudinal axis, the splitter station having an alignment member positioned to receive the segment, and a splitter assembly having a blade adjacent to the alignment member and configured to slice the segment along its length parallel to the longitudinal axis to open the segment from a cylindrical shape to a substantially flat, planar shape; and a planar station adjacent to the splitter station and positioned to receive the sliced segment, the planar station having a third support platform, a plurality of rollers spaced above the third support platform and positioned to engage and flatten the sliced segment against the third support platform, and a planer adjacent to the plurality of rollers and configured to trim the top and/or bottom surfaces of the flat segment.

2. The cane processing assembly of claim 1 wherein the feeder has an alignment guide positioned to receive and align the segment with the open central area of the annular cutter assembly.

3. The cane processing assembly of claim 1 wherein the feeder has a retractable stopper positioned to block the segment from prematurely moving to the perforating station.

4. The cane processing assembly of claim 3 wherein the stopper is a retractable member movable between an extended, blocking position and a retracted non-blocking position.

5. The cane processing assembly of claim 1 wherein the feeding member is a pusher assembly configured to sequentially advance the segment through the cutter assembly to position each node of the segment in alignment with the blades.

6. The cane processing assembly of claim 1 wherein the driver comprises an annular blade driver rotatably coupled to the blades, where rotational movement of the annular blade driver causes the blades to move radially between the retracted position and the extended position.

7. The cane processing assembly of claim 6, wherein the annular blade driver comprises a plurality of radially extending driver teeth positioned to engage the blades and drive the blades radially inwardly from the retracted position to the extended position.

8. The cane processing assembly of claim 1 wherein the blades are biased toward the retracted position.

9. The cane processing assembly of claim 1, further comprising a loader adjacent to the feeder and configured to retain a plurality of substantially cylindrical segments of bamboo culms or vegetable canes, wherein the loader is configured to provide the segment from the plurality of segments onto the feeder.

10. A culm processing assembly for use with a substantially cylindrical bamboo culm, wherein the culm has a longitudinal axis and a plurality of spaced apart fibrous nodes, the assembly comprising:

a feeder positioned to move the culm in a direction substantially parallel to the longitudinal axis;

a perforating station adjacent to the feeder to receive the culm, the perforating station having an annular cutter assembly with blades positioned around an open central area that receives the culm, the blades being radially movable between retracted and extended positions, wherein the blades are positioned to radially perforate a node of the culm substantially around the circumference of the culm when the blades move to the extended position;

a splitter station positioned to receive the culm after the culm has moved through the perforating station, the splitter station having an alignment member positioned to receive the culm, and a splitting blade adjacent to the alignment member and configured to slice the culm along its length; and a planar station adjacent to the splitter station and positioned to receive the sliced culm, the planar station having a plurality of rollers positioned to engage and flatten the sliced culm into a planar configuration with the node of flattened culm perforated.

11. A cane processing assembly for use with segments of bamboo culms or vegetable canes, wherein each segment has a longitudinal axis and fibrous portions, the assembly comprising:

a feeder positioned to move a segment in a direction substantially parallel to the longitudinal axis;

a perforating station adjacent to the feeder to receive the segment, the perforating station having an annular cutter assembly with blades positioned around an open central area that receives the segment, the blades being radially movable between retracted and extended positions, wherein the blades are positioned to radially perforate a fibrous portion of the segment substantially around the circumference of the segment when the blades move to the extended position;

a splitter station positioned to receive the segment after the segment has moved through the perforating station, the splitter station having an alignment member positioned to receive the segment, and a splitting blade adjacent to the alignment member and configured to slice the segment along its length; and a planar station adjacent to the splitter station and positioned to receive the sliced segment, the planar station having a plurality of rollers positioned to engage and flatten the sliced segment into a planar configuration.

* * * * *